US007852054B2

(12) United States Patent
Kao et al.

(10) Patent No.: US 7,852,054 B2
(45) Date of Patent: Dec. 14, 2010

(54) LOW DROPOUT REGULATOR AND THE OVER CURRENT PROTECTION CIRCUIT THEREOF

(75) Inventors: Shun Hau Kao, Hsinchu (TW); Mao Chuan Chien, Hsinchu (TW)

(73) Assignee: Advanced Analog Technology, Inc., Hsinchu (TW)

( * ) Notice: Subject to any disclaimer, the term of this patent is extended or adjusted under 35 U.S.C. 154(b) by 296 days.

(21) Appl. No.: 12/236,064

(22) Filed: Sep. 23, 2008

(65) Prior Publication Data

US 2010/0026254 A1 Feb. 4, 2010

(30) Foreign Application Priority Data

Jul. 29, 2008 (TW) ..... 97128571 A

(51) Int. Cl.
*G05F 1/573* (2006.01)

(52) U.S. Cl. ..... 323/277; 323/279

(58) Field of Classification Search ..... 323/269, 323/273, 274, 275, 276, 277, 279, 280
See application file for complete search history.

(56) References Cited

U.S. PATENT DOCUMENTS

| | | | | |
|---|---|---|---|---|
| 7,015,680 | B2 | 3/2006 | Moraveji et al. | |
| 7,053,591 | B2 * | 5/2006 | Amrani et al. | 323/222 |
| 7,411,376 | B2 * | 8/2008 | Zhang | 323/277 |
| 7,602,162 | B2 * | 10/2009 | Bansal et al. | 323/277 |
| 7,622,902 | B1 * | 11/2009 | Kao et al. | 323/276 |
| 7,759,923 | B2 * | 7/2010 | Miller et al. | 323/285 |

* cited by examiner

*Primary Examiner*—Gary L Laxton
(74) *Attorney, Agent, or Firm*—WPAT, P.C.; Anthony King

(57) ABSTRACT

An over current protection circuit for low dropout regulator comprises a sense transistor, a sense resistor, an operational amplifier and a first transistor. The sense transistor senses the current flowing through the power transistor. The sense resistor is coupled to the sense transistor and shares the same current flowing through the sense transistor. The operational amplifier outputs a control signal according to the voltage across the sense resistor and a reference voltage. The first transistor controls the power transistor according to the control signal.

22 Claims, 3 Drawing Sheets

LOW DROPOUT REGULATOR AND THE OVER CURRENT PROTECTION CIRCUIT THEREOF

BACKGROUND OF THE INVENTION

1. Field of the Invention

The present invention relates to an over current protection circuit, and more particularly, to an over current protection circuit for a low dropout regulator.

2. Description of the Related Art

A low dropout regulator, one kind of linear regulator, provides an output voltage slightly lower than its input voltage. Like most power supply circuits, a low dropout regulator requires an over current protection mechanism to prevent itself and the load circuit thereof from being damaged by its output current. FIG. 1 shows a conventional low dropout regulator and the over current protection circuit thereof. The low dropout regulator 100, coupled to a load circuit 160, comprises an NMOS power transistor 110, an error amplifier 120 and resistors 130 and 140. The over current protection circuit 150 comprises a current-limiting amplifier 151, a current source 152, resistors 153 and 154 and an NMOS transistor 155.

As shown in FIG. 1, the source electrode of the power transistor 110 is coupled to the load circuit 160. The gate electrode of the power transistor 110 is coupled to the output terminal of the error amplifier 120. One end of the resistor 130 is coupled to the source electrode of the power transistor 110, and the other end of the resistor 130 is coupled to the inverting input terminal of the error amplifier 120. One end of the resistor 140 is coupled to the inverting input terminal of the error amplifier 120, and the other end of the resistor 140 is grounded. The non-inverting input terminal of the error amplifier 120 is coupled to a bandgap voltage. The resistor 153 connects a supply voltage to the drain electrode of the power transistor 110. The resistor 154 connects the supply voltage to the non-inverting input terminal of the current-limiting amplifier 151. The current source 152 is coupled to the non-inverting input terminal of the current-limiting amplifier 151. The gate electrode of the transistor 155 is coupled to the output terminal of the current-limiting amplifier 151. The source electrode of the transistor 155 is grounded. The drain electrode of the transistor 155 is coupled to the output terminal of the error amplifier 120.

The current $I_1$ provided by the current source 152 is fixed, and therefore the voltage across the resistor 154, $V_A$, is also fixed. When the current flowing through the power transistor 110 is over a threshold, i.e., when the voltage across the resistor 153, $V_B$, is higher than the voltage across the resistor 154, $V_A$, the current-limiting amplifier 151 outputs a high voltage to activate the transistor 155. The transistor 155 then pulls down the voltage at the gate electrode of the power transistor 110 to turn off the power transistor 110, and the output current of the low dropout regulator 100 is restrained.

However, since the output current of the power transistor 110 equals the current flowing through the resistor 153, the voltage across the resistor 153, $V_B$, is considerably high. Therefore, the voltage dropout between the supply voltage and the output voltage of the low dropout regulator 100 increases significantly, which contradicts the main function thereof. In addition, the dissipated heat caused by the resistor 153 raises the chip temperature such that the performance of the low dropout regulator 100 is degraded and the heat dissipation problem thereof is aggravated.

In view of the drawbacks of the aforesaid prior art, it is necessary to design a low dropout regulator and an over current protection circuit thereof such that the low dropout regulator is not damaged by an over current, the voltage difference of the input and output voltages of the low dropout regulator does not increase, and the heat dissipation problem is not aggravated.

SUMMARY OF THE INVENTION

The over current protection circuit for a low dropout regulator according to one embodiment of the present invention comprises a sense transistor, a sense resistor, an operational amplifier and a first transistor, wherein the low dropout regulator comprises a power transistor. The sense transistor is configured to sense the current flowing through the power transistor. The sense resistor is coupled to the sense transistor and shares the same current flowing through the sense transistor. The operational amplifier is configured to output a control signal according to the voltage across the sense resistor and a reference voltage. The first transistor is configured to control the power transistor according to the control signal.

The over current protection circuit for low dropout regulator according to another embodiment of the present invention comprises a sense transistor, a sense resistor, a current source, a first current-mirror circuit, a second current-mirror circuit, a first resistor and a first transistor, wherein the low dropout regulator comprises a power transistor. The sense transistor is configured to sense the current flowing through the power transistor. The sense resistor is coupled to the sense transistor and shares the same current flowing through the sense transistor. The first current-mirror circuit is coupled to the current source and forms a first part of first current path and a first part of a second current path. The second current-mirror circuit is coupled to the current source and forms a second part of the first current path and a second part of the second current path. The first resistor is coupled to the second current-mirror circuit and forms a third part of the first current path. The first transistor is configured to control the power transistor according to the voltages across the sense resistor and the first resistor.

The low dropout regulator with over current protection mechanism according to another embodiment of the present invention comprises an NMOS power transistor, an error amplifier, a sense transistor, a sense resistor, a current source, a first current-mirror circuit, a second current-mirror circuit, a first resistor and a first transistor. The drain electrode of the NMOS power transistor is coupled to a supply voltage. The source electrode of the NMOS power transistor is coupled to a feedback circuit. The non-inverting input terminal of the error amplifier is coupled to a reference voltage. The inverting input terminal of the error amplifier is coupled to the feedback circuit. The output terminal of the error amplifier is coupled to the gate electrode of the power transistor. The sense transistor is configured to sense the current flowing through the power transistor. The sense resistor is coupled to the sense transistor and shares the same current flowing through the sense transistor. The first current-mirror circuit is coupled to the current source and forms a first part of a first current path and a first part of a second current path. The second current-mirror circuit is coupled to the current source and forms a second part of the first current path and a second part of the second current path. The first resistor is coupled to the second current-mirror circuit and forms a third part of the first current path. The first transistor is configured to control the power transistor according to the voltages across the sense resistor and the first resistor.

BRIEF DESCRIPTION OF THE DRAWINGS

The objectives and advantages of the present invention will become apparent upon reading the following description and upon referring to the accompanying drawings of which.

DETAILED DESCRIPTION OF THE INVENTION

Figure 1:
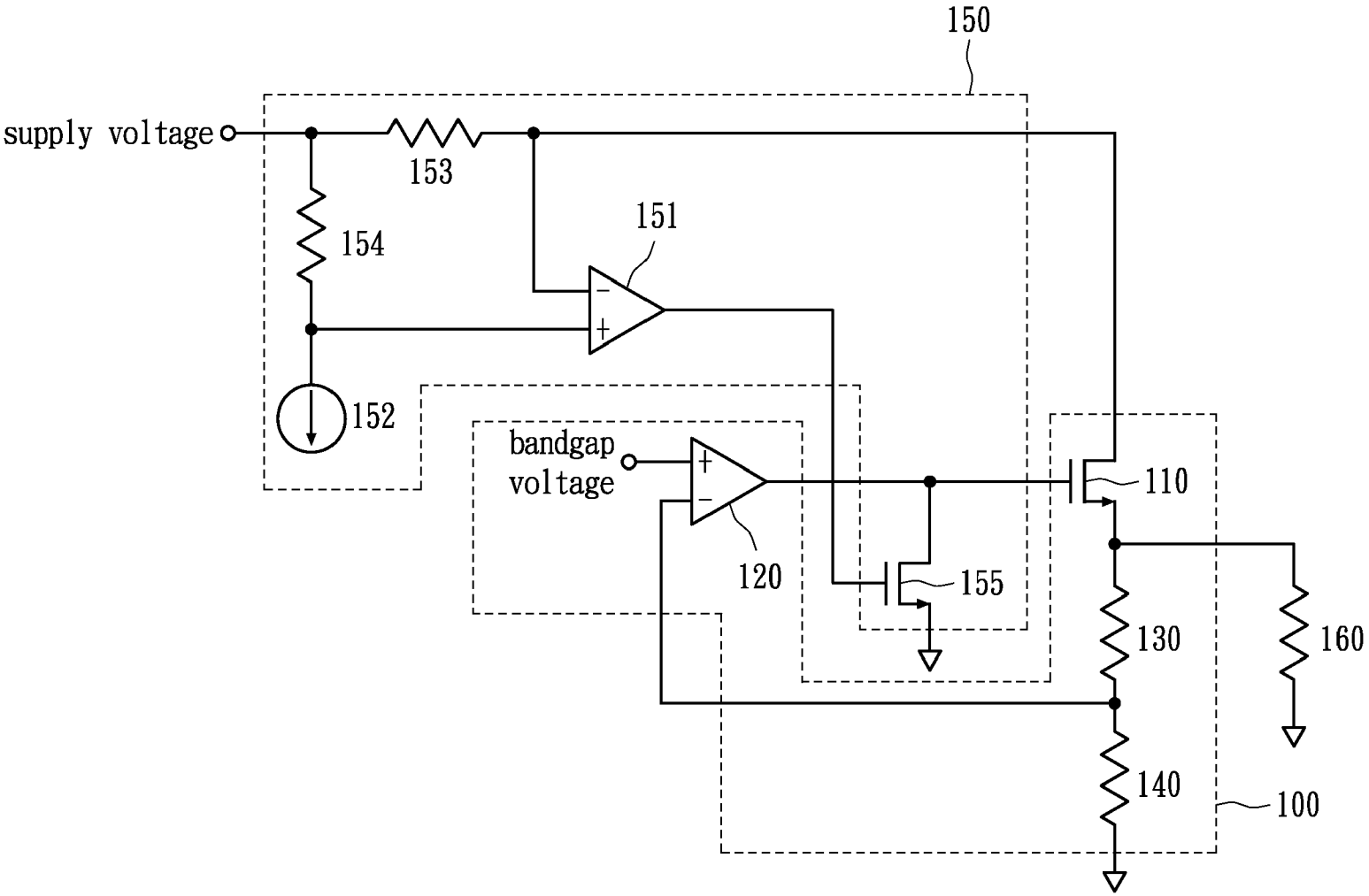
FIG. 1 (Prior Art)
FIG. 1 shows a conventional low dropout regulator and the over current protection circuit thereof.
Figure 2:
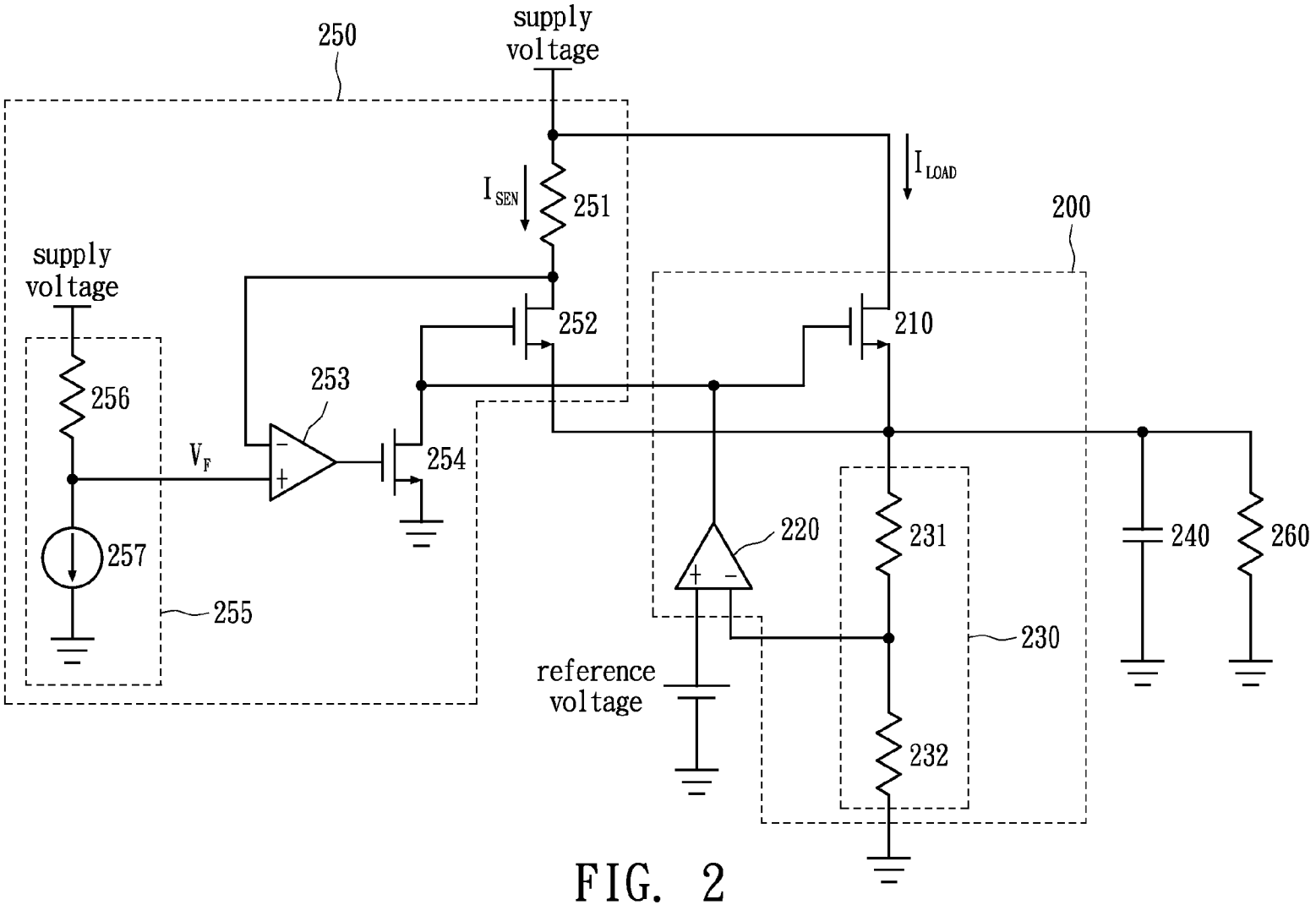
FIG. 2 shows the block diagram of an over current protection circuit for low dropout regulator according to one embodiment of the present invention.

FIG. 2 shows the block diagram of an over current protection circuit for low dropout regulator according to one embodiment of the present invention. The low dropout regulator 200, coupled to a capacitor 240 and a load circuit 260, comprises a power transistor 210, an error amplifier 220 and a feedback circuit 230. The power transistor 210 is an NMOS transistor. The source electrode of the power transistor 210 is coupled to the common node of the load circuit 260, the capacitor 240 and the feedback circuit 230. The drain electrode of the power transistor 210 is coupled to a supply voltage. The gate electrode of the power transistor 210 is coupled to the output terminal of the error amplifier 220. The non-inverting input terminal of the error amplifier 220 is coupled to a reference voltage $V_{BG}$. The inverting input terminal of the error amplifier 220 is coupled to the feedback circuit 230. The feedback circuit 230 comprises resistors 231 and 232. One end of the resistor 231 is coupled to the source electrode of the power transistor 210, and the other end is coupled to the inverting input terminal of the error amplifier 220. The resistor 232 connects the inverting input terminal of the error amplifier 220 to ground.

The over current protection circuit 250 comprises a sense resistor 251, a sense transistor 252, an operational amplifier 253, a first transistor 254 and a reference voltage circuit 255. The sense transistor 252 is an NMOS transistor. The gate electrode of the sense transistor 252 is coupled to the gate electrode of the power transistor 210. The source electrode of the sense transistor 252 is coupled to the source electrode of the power transistor 210. One end of the sense resistor 251 is coupled to the supply voltage, and the other end is coupled to the drain electrode of the sense transistor 252. The first transistor 254 is an NMOS transistor. The drain electrode of the first transistor 254 is coupled to the gate electrode of the sense transistor 252. The gate electrode of the first transistor 254 is coupled to the output terminal of the operational amplifier 253. The source electrode of the first transistor 254 is grounded. The inverting input terminal of the operational amplifier 253 is coupled to the drain electrode of the sense transistor 252. The non-inverting input terminal of the operational amplifier 253 is coupled to a reference voltage $V_F$ provided by the reference voltage circuit 255. The reference voltage circuit 255 comprises a first resistor 256 and a current source 257. One end of the first resistor 256 is coupled to the supply voltage, and the other end is coupled to the common node of the current source 257 and the non-inverting input terminal of the operational amplifier 253. The current source 257 provides a fixed current and generates the reference voltage $V_F$ at the non-inverting input terminal of the operational amplifier 253.

The width-to-length ratio (W/L) of the sense transistor 252 is 1/K times that of the power transistor 210. Therefore, the current flowing through the sense transistor 252, $I_{SEN}$, is 1/K times the current flowing through the power transistor 210, $I_{LOAD}$. When the low dropout regulator 200 operates in normal mode, the operational amplifier 253 outputs a low voltage, and the first transistor 254 is non-activated. When the current $I_{LOAD}$ flowing through the power transistor 210 is over a threshold, that is, when the voltage across the sense resistor 251 ($I_{SEN}$ multiplied by the resistance of the sense resistor 251) is higher than a threshold, the voltage at the non-inverting input terminal of the operational amplifier 253 is higher than that at the inverting input terminal of the operational amplifier 253. At such point, the operational amplifier 253 outputs a high voltage to activate the first transistor 254. The voltage at the drain electrode of the first transistor 254 is then pulled to a low voltage such that the current flowing through the power transistor 210 is restrained.

Comparing the low dropout regulator 200 and the over current protection circuit 250 to the aforesaid prior art, it is clear that the low dropout regulator 200 is not negatively affected by the addition of the over current protection circuit 250, but still retains a low dropout voltage between its input and output voltages. On the other hand, since the current $I_{SEN}$ is relatively small, the heat generated thereby would not cause any serious heat dissipation problem. In addition, the current $I_{SEN}$ flows to the load circuit 260 and therefore does not add to the current flowing through the over current protection circuit 250.

Figure 3:
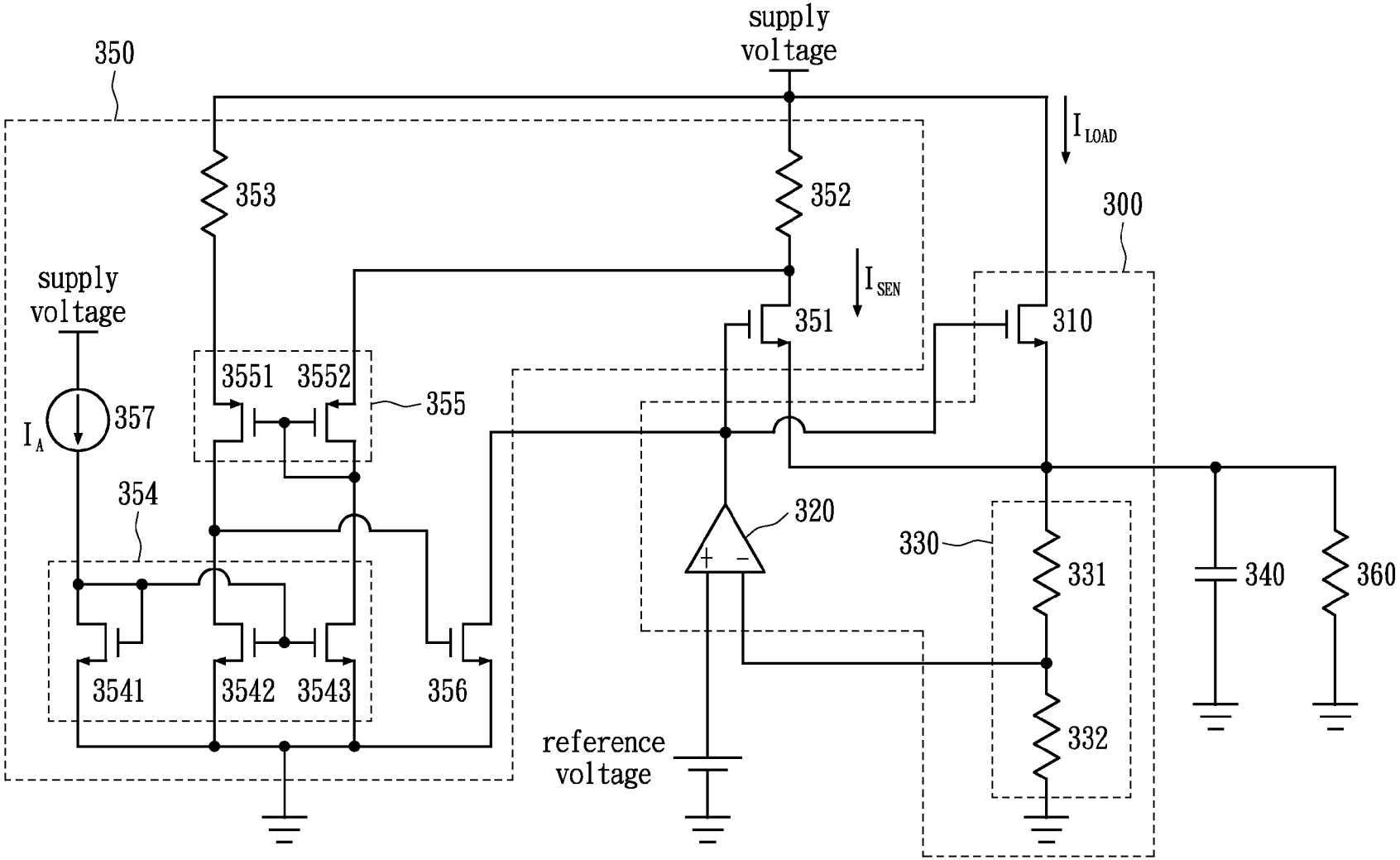
FIG. 3 shows the block diagram of an over current protection circuit for low dropout regulator according to another embodiment of the present invention.

FIG. 3 shows the block diagram of an over current protection circuit for low dropout regulator according to another embodiment of the present invention. The structure of the low dropout regulator 300 is substantially the same as the structure of the low dropout regulator 200. The low dropout regulator 300, coupled to a capacitor 340 and a load circuit 360, comprises a power transistor 310, an error amplifier 320 and a feedback circuit 330. The feedback circuit 330 comprises resistors 331 and 332.

The over current protection circuit 350 is simplified compared to the over current protection circuit 250. The over current protection circuit 350 comprises a sense transistor 351, a sense resistor 352, a first resistor 353, a first current-mirror circuit 354, a second current-mirror circuit 355, a first transistor 356 and a current source 357. The first current-mirror circuit 354 comprises a second transistor 3541, a third transistor 3542 and a fourth transistor 3543. The second current-mirror circuit 355 comprises a fifth transistor 3551 and a sixth transistor 3552.

The sense transistor 351 is an NMOS transistor. The gate electrode of the sense transistor 351 is coupled to the gate electrode of the power transistor 310. The source electrode of the sense transistor 351 is coupled to the source electrode of the power transistor 310. One end of the sense resistor 352 is coupled to a supply voltage, and the other end is coupled to the drain electrode of the sense transistor 351. The first transistor 356 is an NMOS transistor. The drain electrode of the first transistor 356 is coupled to the gate electrode of the sense transistor 351. The source electrode of the first transistor 356 is grounded. The second transistor 3541, the third transistor 3542 and the fourth transistor 3543 are all NMOS transistors, and the size ratios thereof are substantially the same. The drain electrode of the second transistor 3541 is coupled to the gate electrode of the second transistor 3541. The source electrode of the second transistor 3541 is grounded. The drain electrode of the third transistor 3542 is coupled to the gate electrode of the first transistor 356. The gate electrode of the third transistor 3542 is coupled to the gate electrode of the second transistor 3541. The source electrode of the third transistor 3542 is grounded. The gate electrode of the fourth transistor 3543 is coupled to the gate electrode of the second transistor 3541. The source electrode of the fourth transistor 3543 is grounded. The output terminal of the current source 357 is coupled to the drain electrode of the second transistor 3541.

The fifth transistor 3551 and the sixth transistor 3552 are both PMOS transistors, and the size ratios thereof are substantially the same. The gate electrode of the fifth transistor 3551 is coupled to the gate electrode of the sixth transistor 3552. The drain electrode of the fifth transistor 3551 is coupled to the drain electrode of the third transistor 3542. The gate electrode of the sixth transistor 3552 is coupled to the drain electrode of the sixth transistor 3552. The source electrode of the sixth transistor 3552 is coupled to the drain electrode of the sense transistor 351. One end of the first resistor 353 is coupled to the supply voltage, and the other end is coupled to the source electrode of the fifth transistor 3551.

As shown in FIG. 3, the first resistor 353, fifth transistor 3551 and the third transistor 3542 form a first current path. The sixth transistor 3552 and the fourth transistor 3543 form a second current path.

The width-to-length ratio of the sense transistor 351 is 1/K times that of the power transistor 310. Therefore, the current flowing through the sense transistor 351, $I_{SEN}$, is 1/K times the current flowing through the power transistor 310, $I_{LOAD}$. The resistance of the sense resistor 352 is much smaller than that of the first resistor 353. The current source 357 provides a fixed current $I_A$ flowing through the second transistor 3541. The first current-mirror circuit 354 mirrors the current $I_A$ such that the current flowing through the third transistor 3542 and the fourth transistor 3543 are also $I_A$. According to the same principle, the current flowing through the fifth transistor 3551 and the sixth transistor 3552 are also $I_A$.

When the low dropout regulator 300 operates in normal mode, the voltage across the sense resistor 352 caused by the current $I_{SEN}$ is negligible. In addition, since the resistance of the sense resistor 352 is much smaller than that of the first resistor 353, the voltage across the sense resistor 352 is much lower than that of the first resistor 353. Therefore, the gate-to-source voltage of the third transistor 3542 is much higher than that of the fifth transistor 3551. At such point, the fifth transistor 3551 is non-activated such that the voltage at the drain electrode of the fifth transistor 3551 is not high enough to activate the first transistor 356.

When the current $I_{LOAD}$ flowing through the power transistor 210 is over a threshold, the sensed current $I_{SEN}$ generates a sufficient voltage across the sense resistor 352. In consequence, the gate-to-source voltage of the fifth transistor 3551 is sufficient to activate the fifth transistor 3551. At such point, the voltage at the drain electrode of the fifth transistor 3551 is sufficient to activate the first transistor 356. The activated first transistor 356 then pulls down the voltage at its drain electrode, that is, the voltage at the gate electrode of the power transistor 310. In consequence, the current $I_{LOAD}$ is restrained.

Comparing the low dropout regulator 300 and the over current protection circuit 350 to the aforesaid prior art, it is clear that the low dropout regulator 300 is not negatively affected by the over current protection circuit 350, but still retains a low dropout voltage between its input and output voltages. On the other hand, since the current $I_{SEN}$ is relatively small, the heat generated thereby would not cause any serious heat dissipation problem. In addition, the current $I_{SEN}$ flows to the load circuit 360 such that it does not contribute to the current flowing through the over current protection circuit 350.

The above-described embodiments of the present invention are intended to be illustrative only. Those skilled in the art may devise numerous alternative embodiments without departing from the scope of the following claims.

What is claimed is:

1. An over current protection circuit for a low dropout regulator, the low dropout regulator comprising a power transistor, the over current protection circuit comprising:

a sense transistor configured to sense a current flowing through the power transistor;

a sense resistor coupled to the sense transistor, the sense resistor sharing the same current flowing through the sense transistor;

an operational amplifier configured to output a control signal according to a voltage across the sense resistor and a reference voltage; and a first transistor configured to control the power transistor according to the control signal.

2. The over current protection circuit of claim 1, wherein the power transistor, the sense transistor and the first transistor are all NMOS transistors.

3. The over current protection circuit of claim 2, wherein the source electrode of the sense transistor is coupled to the source electrode of the power transistor, and the gate electrode of the sense transistor is coupled to the gate electrode of the power transistor.

4. The over current protection circuit of claim 2, wherein one end of the sense resistor is coupled to a common node of the drain electrode of the power transistor and a supply voltage, and the other end is coupled to the drain electrode of the sense transistor.

5. The over current protection circuit of claim 2, wherein the inverting input terminal of the operational amplifier is coupled to the drain electrode of the sense transistor, and the non-inverting input terminal of the operational amplifier is coupled to the reference voltage.

6. The over current protection circuit of claim 2, wherein the drain electrode of the first transistor is coupled to the gate electrode of the sense transistor, the gate electrode of the first transistor is coupled to the output terminal of the operational amplifier, and the source electrode of the first transistor is grounded.

7. The over current protection circuit of claim 1, wherein the reference voltage is provided by a reference voltage circuit, the reference voltage circuit comprising:

a first resistor with one end coupled to a supply voltage, and the other end coupled to a non-inverting input terminal of the operational amplifier; and a current source coupled to the non-inverting input terminal of the operational amplifier.

8. An over current protection circuit for a low dropout regulator, the low dropout regulator comprising a power transistor, the over current protection circuit comprising:

a sense transistor configured to sense the current flowing through the power transistor;

a sense resistor coupled to the sense transistor, the sense resistor sharing the same current flowing through the sense transistor;

a current source;

a first current-mirror circuit coupled to the current source so as to form a first part of a first current path and a first part of a second current path;

a second current-mirror circuit coupled to the first current-mirror circuit so as to form a second part of the first current path and a second part of the second current path;

a first resistor coupled to the second current-mirror circuit so as to form a third part of the first current path; and a first transistor configured to control the power transistor according to voltages across the sense resistor and the first resistor.

9. The over current protection circuit of claim 8, wherein the power transistor and the sense transistor are both NMOS transistors.

10. The over current protection circuit of claim 9, wherein the source electrode of the sense transistor is coupled to the source electrode of the power transistor, and the gate electrode of the sense transistor is coupled to the gate electrode of the power transistor.

11. The over current protection circuit of claim 9, wherein one end of the sense resistor is coupled to a common node of the drain electrode of the power transistor and a supply voltage, and the other end is coupled to the drain electrode of the sense transistor.

12. The over current protection circuit of claim 9, wherein the first current-mirror circuit comprises:

a second transistor with its drain electrode coupled to an output terminal of the current source, with its gate electrode coupled to its drain electrode, and with its source electrode grounded;

a third transistor with its drain electrode coupled to the second current-mirror circuit, with its gate electrode coupled to the gate electrode of the second transistor; and with its source electrode grounded; and a fourth transistor with its drain electrode coupled to the second current-mirror circuit, with its gate electrode coupled to the gate electrode of the third transistor, and with its source electrode grounded;

wherein the second transistor, the third transistor and the fourth transistor are all NMOS transistors, and their size ratios are substantially the same.

13. The over current protection circuit of claim 12, wherein the second current-mirror circuit comprises:

a fifth transistor with its drain electrode coupled to the drain electrode of the third transistor, and with its source electrode coupled to the first resistor; and a sixth transistor with its drain electrode coupled to a common node of its gate electrode and the drain electrode of the fourth transistor, with its gate electrode coupled to the gate electrode of the fifth transistor, and with its source electrode coupled to the drain electrode of the sense transistor;

wherein the fifth transistor and the sixth transistor are both PMOS transistors, and their size ratios are substantially the same.

14. The over current protection circuit of claim 13, wherein the first transistor is an N type transistor with its drain electrode coupled to the gate electrode of the sense transistor, with its gate electrode coupled to the drain electrode of the fifth transistor, and with its source electrode grounded.

15. A low dropout regulator with an over current protection mechanism comprising:

an NMOS power transistor with its drain electrode coupled to a supply voltage, and with its source electrode coupled to a feedback circuit;

an error amplifier with its non-inverting input terminal coupled to a reference voltage, with its inverting input terminal coupled to the feedback circuit, and with its output terminal coupled to the gate electrode of the power transistor;

a sense transistor configured to sense a current flowing through the power transistor;

a sense resistor coupled to the sense transistor, the sense resistor sharing the same current flowing through the sense transistor;

a current source;

a first current-mirror circuit coupled to the current source so as to form a first part of a first current path and a first part of a second current path;

a second current-mirror circuit coupled to the first current-mirror circuit so as to form a second part of the first current path and a second part of the second current path;

a first resistor coupled to the second current-mirror circuit so as to form a third part of the first current path; and a first transistor configured to control the power transistor according to voltages across the sense resistor and the first resistor.

16. The low dropout regulator of claim 15, wherein the sense transistor is an NMOS transistor.

17. The low dropout regulator of claim 16, wherein the source electrode of the sense transistor is coupled to the source electrode of the power transistor, and the gate electrode of the sense transistor is coupled to the gate electrode of the power transistor.

18. The low dropout regulator of claim 16, wherein one end of the sense resistor is coupled to a common node of the drain electrode of the power transistor and a supply voltage, and the other end is coupled to the drain electrode of the sense transistor.

19. The low dropout regulator of claim 16, wherein the first current-mirror circuit comprises:

a second transistor with its drain electrode coupled to an output terminal of the current source, with its gate electrode coupled to its drain electrode, and with its source electrode grounded;

a third transistor with its drain electrode coupled to the second current-mirror circuit, with its gate electrode coupled to the gate electrode of the second transistor; and with its source electrode grounded; and a fourth transistor with its drain electrode coupled to the second current-mirror circuit, with its gate electrode coupled to the gate electrode of the third transistor, and with its source electrode grounded;

wherein the second transistor, the third transistor and the fourth transistor are all NMOS transistors, and their size ratios are substantially the same.

20. The low dropout regulator of claim 19, wherein the second current-mirror circuit comprises:

a fifth transistor with its drain electrode coupled to the drain electrode of the third transistor, and with its source electrode coupled to the first resistor; and a sixth transistor with its drain electrode coupled to a common node of its gate electrode and the drain electrode of the fourth transistor, with its gate electrode coupled to the gate electrode of the fifth transistor, and with its source electrode coupled to the drain electrode of the sense transistor;

wherein the fifth transistor and the sixth transistor are both NMOS transistors, and the size ratios thereof are substantially the same.

21. The low dropout regulator of claim 20, wherein the first transistor is an N type transistor with its drain electrode coupled to the gate electrode of the sense transistor, with its gate electrode coupled to the drain electrode of the fifth transistor, and with its source electrode grounded.

22. The low dropout regulator of claim 15, wherein the feedback circuit comprises:

a second resistor with one end coupled to the source electrode of the power transistor, and the other end coupled to the inverting input terminal of the error amplifier; and a third resistor with one end coupled to the inverting input terminal of the error amplifier, and the other end grounded.

* * * * *